United States Patent [19]

Rigby

[11] 4,382,053

[45] May 3, 1983

[54] HOT PRESSING OF CERAMIC MATERIALS

[75] Inventor: Frank Rigby, Blackpool, England

[73] Assignee: United Kingdom Atomic Energy Authority, London, England

[21] Appl. No.: 287,107

[22] Filed: Jul. 27, 1981

[30] Foreign Application Priority Data

Aug. 1, 1980 [GB] United Kingdom ..... 8025235

[51] Int. Cl.[3] ..... B28B 5/00

[52] U.S. Cl. ..... 264/120; 425/233; 425/234; 425/236; 425/257; 425/DIG. 54

[58] Field of Search ..... 425/233, 234, 236, 257, 425/DIG. 54; 264/120

[56] References Cited

U.S. PATENT DOCUMENTS 2,964,400 12/1960 Brennan ..... 425/DIG. 54

FOREIGN PATENT DOCUMENTS 963084 7/1964 United Kingdom ..... 425/DIG. 54

1037213 7/1966 United Kingdom .

*Primary Examiner*—Maurice J. Welsh

*Attorney, Agent, or Firm*—William R. Hinds

[57] ABSTRACT

The hot pressing of ceramic material in dies forming a column, each die being shaped to interfit and cooperate with adjacent dies to cause densification of ceramic material within the dies when pressure is applied to the column. The column of dies is passed intermittently through a fixed, heated zone and pressure is applied to the column intermittently to move the dies through the heated zone and, as a separate step, to compress the column and cause densification of ceramic material in the dies.

11 Claims, 3 Drawing Figures

HOT PRESSING OF CERAMIC MATERIALS

BACKGROUND TO THE INVENTION

This invention relates to the hot pressing of ceramic materials. By hot pressing is meant a process which involves pressing at a temperature such that physical deformation of the crystallites or powder particles forming the ceramic material occurs. It is to be distinguished from warm pressing in which the powder particles merely adhere to each other without creeping or sintering.

SUMMARY OF THE INVENTION

According to a first aspect of the invention a method of hot pressing ceramic material includes passing a column of dies loaded with the ceramic material to be hot pressed intermittently through a fixed heated zone and applying intermittent pressure to the column of dies to cause densification of the ceramic material within the dies.

The dies may be made to pass through the heated zone intermittently by removing dies containing hot pressed bodies from one end of the column one at a time and adding dies containing ceramic material to be hot pressed to the other end of the column one at a time.

According to a second aspect of the invention apparatus for hot pressing ceramic material comprises a fixed heated zone, a column of dies for containing the ceramic material to be hot pressed, said dies being adapted to co-operate with adjacent dies to cause densification of the ceramic material within them when pressure is applied to the column, means for passing the dies intermittently through the heated zone and means for applying intermittent pressure to the column of dies to cause densification of the ceramic material within the dies.

The means for passing the dies intermittently through the heating zone may include means for releasing dies one at a time from one end of the column by the addition of dies one at a time to the other end of the column.

DESCRIPTION OF THE DRAWINGS

The invention will be illustrated by the following description of apparatus for and a method of hot pressing ceramic materials given by way of example only; the description has reference to the accompanying drawings in which.

DESCRIPTION OF PREFERRED EMBODIMENTS

Figure 1:
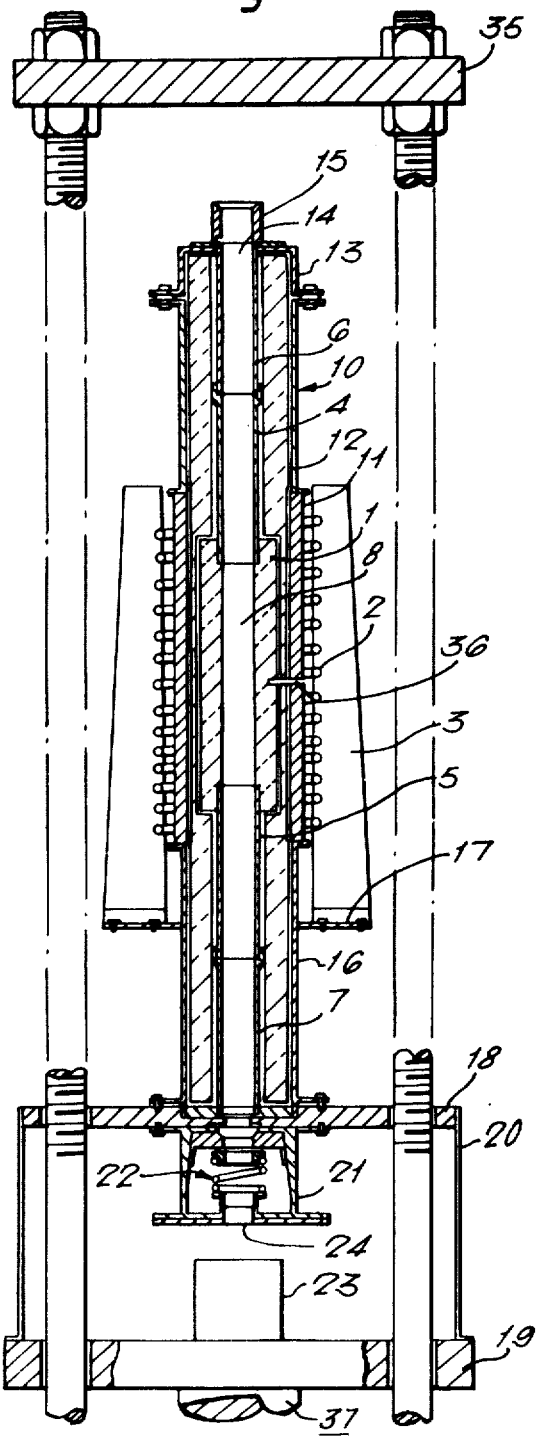
FIG. 1 is a cross-sectional view of apparatus for hot pressing ceramic materials.

Referring now to FIG. 1 the apparatus shown has a tubular susceptor 1 of graphite which is heated by a high frequency generator (not shown) which is coupled to the graphite susceptor 1 by a spirally wound coil 2 of copper tubing. The coil 2 is water-cooled and is located around the apparatus by stanchions 3 constructed from asbestos sheet. Graphite guide tubes 4, 5 are screwthreadably received in the ends of the susceptor 1 and are in turn a sliding fit in alumina guide tubes 6, 7. The use of alumina for the uppermost and lowermost guide tubes 6, 7 reduces the heat loss from the susceptor by conduction. The temperature at the connection between the graphite guide tubes 4, 5 and the alumina guide tubes 6, 7 should not exceed 1300° C. during operation of the apparatus to avoid chemical reaction between the graphite and the alumina. The guide tubes 4, 5, 6, 7 and the bore of the susceptor 1 provide a passageway 8 through the centre of the apparatus in which a column of dies 9 (FIG. 2) or 39 (FIG. 3) can be located. The diametral clearance between the dies 9 or 39 and the inside of the passageway 8 should be small to ensure adequate heat transfer from the susceptor 1, to minimise oxidation of the graphite by air drawn into the apparatus by the updraught of air in the passageway 8 and to ensure that the column of dies 9 or 39 is located in alignment and vertically disposed when a load is applied.

The guide tubes 4, 5, 6, 7 and susceptor 1 are located within an outer casing 10 comprising a central impervious silica sheath 11 surrounding the susceptor 1 within the coil 2. The upper end of the silica sheath 11 abuts a stainless steel tube 12 to which is bolted a stainless steel end cap 13. The end cap 13 has a central aperture 14 aligned with the passageway 8 and has an annular baffle plate 15 on its upper face. The bore of the annular baffle plate 15 is of a diameter only slightly larger than the diameter of the dies 9, 39 so that the clearance between the baffle plate 15 and the dies 9, 39 is as small as possible to reduce the flow of air through the passageway 8 caused by convection. The lower end of the silica sheath 11 abuts a stainless steel tube 16 having an annular flange 17 on which the stanchions 3 are supported. The tube 16 is bolted to a support plate 18 which is supported by tie bars 20 above the lower movable platen 19 of a press 37 with a fixed upper platen 35. The underside of the support plate 18 carries a die supporting member 21 containing a spring loaded gripping device 22 which grips the outer surface of a die 9 or 39 and prevents it falling out of the passageway 8 unless force is applied to it. Cooling coils (not shown) surround the member 21. A movable block 23 rests on the platen 19 and may be moved into a position directly below the passageway 8 so that the lowermost of the dies 9, 39 within the passageway contacts it when the column of dies 9, 39 is compressed. The block 23 may be moved to a position where it is not below the passageway 8 in which case slight compression on the column of dies 9, 39 will cause the gripping force of the spring loaded gripping device 22 to be overcome and the lowermost die 9, 39 in the column to be ejected. The lower face of the die supporting member 21 has a lower baffle plate 24 having an aperture only slightly larger than the diameter of each die 9, 39 to minimise ingress of air into the passageway 8. It is desired to minimise the ingress of air so that the life of the graphite components of the apparatus is not markedly reduced by the reaction of the graphite with the air. Indeed it has been found that by allowing a limited supply of air to enter the apparatus during operation an equilibrium mixture of carbon monoxide and carbon dioxide is produced and this forms a protective atmosphere without the complications of a sealed unit.

A reducing atmosphere may be provided in the furnace by introducing a reducing gas, for example, a mixture of argon/4% hydrogen into the furnace. Conveniently an inlet for the reducing gas is arranged above or below the heated zone of the furnace and inlets both above and below the heated zone are preferred.

The temperature of the susceptor 1 may be monitored by the use of a pyrometer focussed at a point midway through the thickness of the wall of the susceptor and viewed via a radial blind bore 36 drilled through the silica sheath 11 and insulation. Alternatively the temperature may be monitored by the use of a thermocouple placed within the susceptor or remote from it. In the latter case it would be necessary to calibrate the thermocouple so that it gave a reading of the susceptor temperature. To minimise loss of heat the gap between the casing 10 and the guide tubes 4, 5, 6, 7 is filled with brittle foam carbon machined to the required shape and the gap between the susceptor 1 and the silica sheath 11 is filled with flexible carbon felt.

Figure 2:
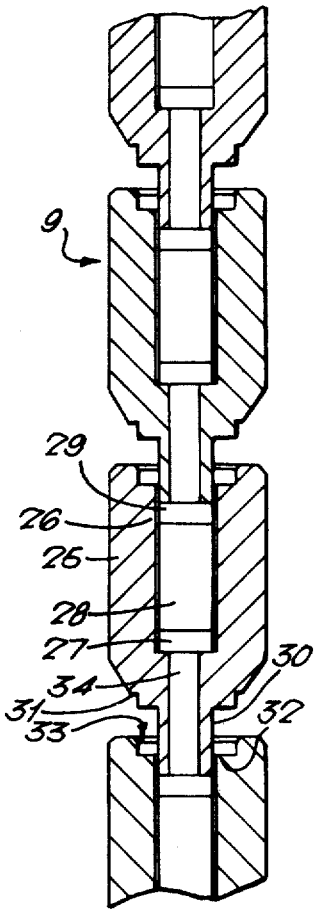
FIGS. 2 and 3 are cross-sectional views on a larger scale than FIG. 1 of part of alternative columns of dies for use in the apparatus of FIG. 1.

Referring now to FIG. 2, which shows part of a column of dies 9 intended for use in the passageway 8 of the apparatus described above, each of the dies 9 has a cylindrical body portion 25 through the centre of which extends a bore 26 of diameter suited to that required of the final hot pressed ceramic body. In use the lower end of the bore 26 is blocked by a lower plug 27 which is a sliding fit within the bore 26. The ceramic material to be hot pressed, which may be powder or a precompacted pellet 28, is placed between the lower plug 27 and an upper plug 29 which is a sliding fit within the bore 26. Each die 9 has a downwardly extending projection 30 which fits into the bore 26 of the die immediately below it in the column and contacts the upper plug thereof. Around the base of the projection 30 is an annular step 31 which co-operates with a shoulder 32 formed by a recess 33 at the upper end of the bore 26 of the die immediately below it to limit the distance the projection 30 can extend into the bore and thus limit the length of the hot pressed body produced. By varying the thickness of one or both of the upper or lower plugs, bodies of different lengths may be produced. A bore 34 of smaller diameter than the bore 26 extends through the projection 30 and communicates with the bore 26 and is used to extract the hot pressed body from the die by inserting a push-rod (not shown) into the bore 34 and pushing the plugs 27, 29 and the hot pressed body out of the upper end of the die 9.

To set up the apparatus described with reference to FIGS. 1 and 2 the passageway 8 is loaded with a column of empty dies 9 until the uppermost die is seen protruding from the top. The power produced by the high frequency generator is then raised until the temperature within the bore of the susceptor 1 is at the desired operating temperature (about 2200° C. for hot pressing boron carbide). A die loaded with the ceramic material to be hot pressed is placed at the top of the column and the platen 19 is raised to exert a low pressure on the column which ejects the lowermost die in the column if the movable block 23 is not underneath the passageway 8. The block 23 is then placed below the passageway 8 and the platen 19 raised so that a higher pressure (about 15 MPa for boron carbide) is applied to the column of dies. The column of dies is compressed between the block 23 and the upper platen 35 of the press. As the dies containing the ceramic material to be hot-pressed pass into the bore of the susceptor 1 at the operating temperature, the compression densifies the ceramic material in the die to form the desired hot-pressed body. The compression force is then removed and a further die loaded with ceramic material placed at the top of the column. A low pressure is again applied with the block 23 removed from underneath the passageway 8 to remove the lowermost die and the block is replaced and the column compressed. After a number of such cycles equal to the number of dies in the column the die ejected from the base of the passageway 8 will contain a hot pressed ceramic body which can be removed along with the plugs 27, 29 using a push-rod inserted into the bore 34 of the die. The die is then reloaded with ceramic material ready for another pass through the susceptor 1 so that when the susceptor has reached the desired operating temperature the apparatus can be used to produce hot-pressed ceramic bodies on a continuous basis and with consistent properties. Thus by placing equal weights of ceramic material in each die pressed bodies of constant density can be obtained.

The shape of the hot-pressed bodies may be varied from the cylindrical bodies described, in particular the invention permits fabrication of annular hot-pressed bodies. Also there may be a single bore in each die or a number of bores symmetrically disposed about the longitudinal axis of the die. Further in the alternative arrangement of FIG. 3 which shows part of a column of dies 39 which can replace the dies 9 in the apparatus of FIG. 1 the dies 39 are provided with liners for their bores or cavities, each liner being retractable from its die with a hot pressed body formed within it.

Figure 3:
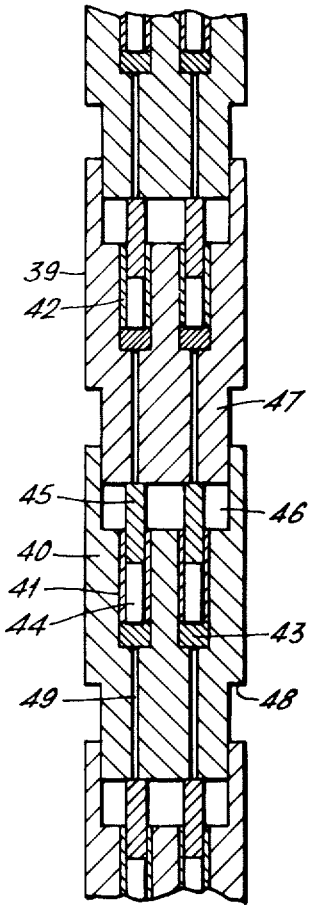

Operation of the apparatus of FIG. 1 with a column of dies 39 as in FIG. 3 is identical to operation with a column of dies 9 as in FIG. 2 which has already been described but referring now to FIG. 3 in more detail each of the dies 39 has a cylindrical body portion 40 through which extend bores 41 arranged in symmetrical array about the longitudinal axis of the body portion 40. The bores 41 are each provided with a liner 42 of a thickness to give the required diameter to a body pressed within the lined bore and the lower end of the bore is blocked by a lower plug 43 on which the liner 42 sits. Both the liner 42 and the lower plug 43 are a sliding fit in the bore 41. In the same manner as described with reference to FIG. 2 ceramic material to be hot pressed, in the form of powder or a precompacted pellet 44, is placed in the lined bore between the lower plug 43 and an upper plug 45 which is also a sliding fit in the bore 41. These upper plugs 45 extend into a recess 46 at the top of each die 39 and the lower end of each die has a projection 47 which fits into the recess 46 of the die 39 below and acts on the upper plugs 45 in that die. A shoulder 48 on each die limits the movement of the dies relative to each other. By varying the thickness of one or both of the plugs 43, 45 bodies of different length may be produced. From the base of each bore 41 a bore 49 of smaller diameter extends through the projection 47 to facilitate extraction from the die of a hot pressed body and the liner 42 by inserting a push rod into the bore 49.

By varying the wall thickness of the liners bodies of different diameter can be produced from the same die. The liners may also serve to protect the bore of the die from erosion either by abrasion or chemical reaction and can be either reusable or expendable. They have a particular advantage when a chemical reaction is possible between the material of the pressed body and the material of the die.

In hot pressing boron carbide which may be pressed directly as powder but is preferably precompacted into pellets 28 or 44 the dies 9, 39 are conveniently constructed of graphite and the plugs 27, 29 or 43, 45 (plus the liners 42) are of graphite coated with boron nitrate on the faces which contact the pellets 28, 44. However, other materials, for example, silicon carbide, may be used for the dies 9, 39 particularly if the ceramic material to be pressed reacts with carbon at the pressing temperature.

The dies 9, 39 which form the column of dies may be re-used after the hot-pressed ceramic body has been removed but when dies made of graphite are used they are eventually oxidised by the oxygen in the air drawn into the passageway 8 and have to be discarded. It is an advantage of the present invention, however, that worn dies are easily replaced. The dies or their liners may also readily be exchanged when a body of a different diameter or shape is required and the dies 39 may be re-used with either the same or different liners 42.

If the liner is to be expendable it may be so thin that it cracks during hot-pressing, thus facilitating the subsequent separation of the hot pressed body after extraction from the die. Alternatively a liner may be so designed, by increasing its wall thickness, to remain whole during hot pressing. In this instance the liner can be used again. It may be convenient to coat the inside of liners with a release agent.

I claim:

1. Apparatus for hot pressing ceramic material comprising:

a fixed heated zone, a column of interfitting dies within the heated zone, each die defining at least one bore for containing the ceramic material to be hot-pressed and being adapted to align itself and cooperate under pressure with adjacent dies directly to cause densification of ceramic material within the bores, means for applying intermittent pressure to the column of dies to cause said densification by movement of the dies relative to each other to increase the extent of interfitting of adjacent dies and further means for passing the dies intermittently through the heated zone.

2. Apparatus according to claim 1 wherein the means for applying intermittent pressure includes a fixed platen and a movable platen, and means for supporting the heated zone and the column of dies are mounted on the movable platen.

3. Apparatus according to claim 1 wherein the further means for passing the dies intermittently through the heated zone includes means for releasing dies one at a time from one end of the column by adding dies one at a time to the other end of the column.

4. Apparatus according to claim 1 wherein said dies each define a plurality of bores disposed symmetrically about the longitudinal axis of the die.

5. Apparatus according to claim 1 wherein a liner is provided for each bore.

6. A method of hot pressing ceramic material in which a column of interfitting dies loaded with ceramic material to be hot pressed is passed intermittently through a fixed heated zone and intermittent pressure is applied to the column of dies to increase the extent of interfitting and effect contraction of the column by movement of the dies relative to and in alignment with each other and cause densification of the ceramic material within the dies.

7. A method according to claim 6 wherein the dies are passed through the heated zone intermittently by adding dies containing ceramic material to be hot pressed to one end of the column one at a time and thereby effecting removal of dies from the other end of the column one at a time.

8. A method according to claim 6 wherein the ceramic material is boron carbide.

9. Apparatus as claimed in claim 1 wherein adjacent dies are telescopically interfitted through respective axial projections and axial recesses.

10. Apparatus as claimed in claim 9 wherein the axial projection of a die extends into the bore of an adjacent die.

11. Apparatus according to claim 9 wherein said at least one bore of a die opens into said axial recess of the die.

* * * * *